US011333449B2

(12) United States Patent
Andersen

(10) Patent No.: US 11,333,449 B2
(45) Date of Patent: May 17, 2022

(54) HEAT EXCHANGER PLATE WITH STRENGTHENED DIAGONAL AREA

(71) Applicant: Danfoss A/S, Nordborg (DK)

(72) Inventor: Benny Andersen, Nordborg (DK)

(73) Assignee: Danfoss A/S, Nordborg (DK)

( * ) Notice: Subject to any disclaimer, the term of this patent is extended or adjusted under 35 U.S.C. 154(b) by 237 days.

(21) Appl. No.: 16/599,329

(22) Filed: Oct. 11, 2019

(65) Prior Publication Data

US 2020/0116440 A1 Apr. 16, 2020

(30) Foreign Application Priority Data

Oct. 15, 2018 (DK) ..... PA201800725

(51) Int. Cl.
*F28F 3/10* (2006.01)
*F28F 3/04* (2006.01)

(52) U.S. Cl.
CPC ..... *F28F 3/10* (2013.01); *F28F 3/048* (2013.01)

(58) Field of Classification Search
CPC ..... F28F 3/10; F28F 3/048
USPC ..... 165/166
See application file for complete search history.

(56) References Cited

U.S. PATENT DOCUMENTS 1,836,318 A 12/1931 Gay
2,790,627 A * 4/1957 Wakeman ..... F28F 3/10 165/167
3,788,394 A 1/1974 Derragon
3,792,730 A * 2/1974 Andersson ..... F28F 3/083 165/167
4,067,203 A 1/1978 Behr
4,219,079 A 8/1980 Sumitomo
4,301,662 A 11/1981 Whitnah
4,420,373 A 12/1983 Egosi
(Continued)

FOREIGN PATENT DOCUMENTS

CN 2405181 Y 11/2000
CN 1309279 A 8/2001
(Continued)

OTHER PUBLICATIONS

US 5,385,033 A, 01/1995, Sandofsky et al. (withdrawn)
(Continued)

*Primary Examiner* — Paul Alvare
(74) *Attorney, Agent, or Firm* — McCormick, Paulding & Huber PLLC

(57) ABSTRACT

A heat transfer plate and/or a plate heat exchanger including the heat transfer plate includes a plate body forming a patterned section and having a first side and a second side opposite to the first side; a gasket groove formed depressed from the plate body in a direction from the first side towards the second side, and having a bottom wall, the bottom wall having a bottom wall body; and where the gasket groove includes at least a first section with a first recess formed on the bottom wall body, depressed from the bottom wall body in the direction from the first side towards the second side, and a second section with a second recess formed on the bottom wall body, depressed from the bottom wall body in the direction from the second side towards the first side, wherein the second section is adapted to accommodate a gasket.

18 Claims, 4 Drawing Sheets

(56) References Cited

U.S. PATENT DOCUMENTS

Figure 1:
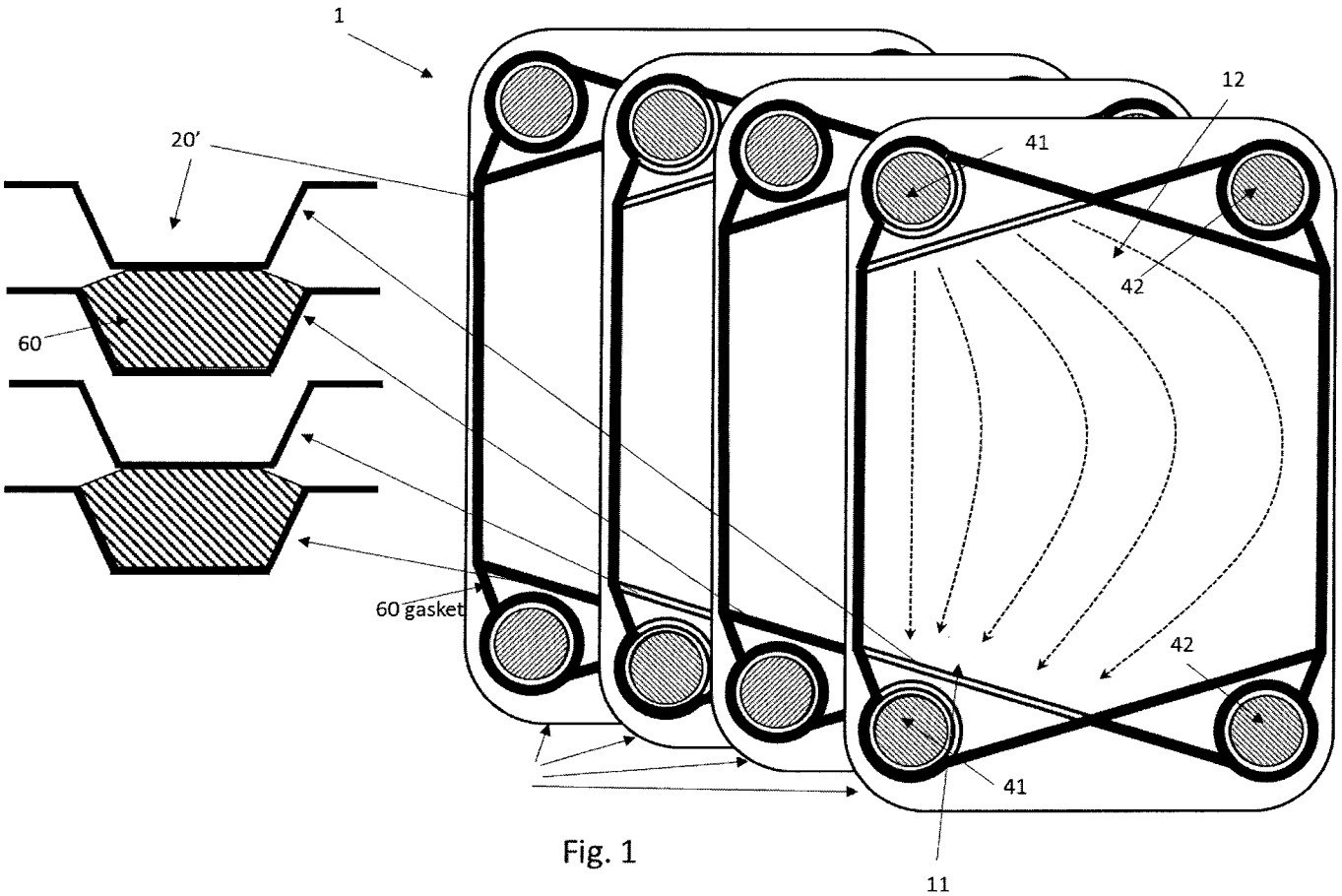

| | | | | |
|---|---|---|---|---|
| 4,432,415 | A * | 2/1984 | Wright | F28F 3/10 165/166 |
| 4,522,037 | A | 6/1985 | Ares et al. | |
| 4,573,327 | A | 3/1986 | Cochran | |
| 4,646,821 | A * | 3/1987 | Almqvist | F28F 3/10 165/166 |
| 5,024,061 | A | 6/1991 | Pfeil, Jr. et al. | |
| 5,226,320 | A | 7/1993 | Dages et al. | |
| 5,553,457 | A | 9/1996 | Reznikov | |
| 5,887,650 | A | 3/1999 | Yang | |
| 6,305,187 | B1 | 10/2001 | Tsuboe et al. | |
| 6,698,221 | B1 | 3/2004 | You | |
| 6,786,056 | B2 | 9/2004 | Bash et al. | |
| 6,823,691 | B2 | 11/2004 | Ohta | |
| 7,178,359 | B2 | 2/2007 | Oshitani et al. | |
| 7,334,427 | B2 | 2/2008 | Ozaki et al. | |
| 7,389,648 | B2 | 6/2008 | Concha et al. | |
| 7,490,660 | B2 * | 2/2009 | Song | F28F 3/10 165/166 |
| 7,844,366 | B2 | 11/2010 | Singh | |
| 8,887,524 | B2 | 11/2014 | Mihara | |
| 8,991,201 | B2 | 3/2015 | Ikegami et al. | |
| 9,217,590 | B2 | 12/2015 | Cogswell et al. | |
| 9,234,710 | B2 * | 1/2016 | Persson | F28F 3/08 |
| 9,752,801 | B2 | 9/2017 | Verma et al. | |
| 2001/0025499 | A1 | 10/2001 | Takeuchi et al. | |
| 2002/0124592 | A1 | 9/2002 | Takeuchi et al. | |
| 2003/0145613 | A1 | 8/2003 | Sakai et al. | |
| 2003/0209032 | A1 | 11/2003 | Ohta | |
| 2004/0003608 | A1 | 1/2004 | Takeuchi et al. | |
| 2004/0003615 | A1 | 1/2004 | Yamaguchi | |
| 2004/0007014 | A1 | 1/2004 | Takeuchi et al. | |
| 2004/0011065 | A1 | 1/2004 | Takeuchi et al. | |
| 2004/0040340 | A1 | 3/2004 | Takeuchi et al. | |
| 2004/0055326 | A1 | 3/2004 | Ikegami et al. | |
| 2004/0060316 | A1 | 4/2004 | Ito et al. | |
| 2004/0069011 | A1 | 4/2004 | Nishida et al. | |
| 2004/0079102 | A1 | 4/2004 | Umebayashi et al. | |
| 2004/0103685 | A1 | 6/2004 | Yamaguchi et al. | |
| 2004/0123624 | A1 | 7/2004 | Ohta et al. | |
| 2004/0211199 | A1 | 10/2004 | Ozaki et al. | |
| 2004/0255602 | A1 | 12/2004 | Sato et al. | |
| 2004/0255612 | A1 | 12/2004 | Nishijima et al. | |
| 2004/0255613 | A1 | 12/2004 | Choi et al. | |
| 2004/0261448 | A1 | 12/2004 | Nishijima et al. | |
| 2006/0236708 | A1 | 10/2006 | Mizuno et al. | |
| 2006/0254308 | A1 | 11/2006 | Yokoyama et al. | |
| 2006/0277932 | A1 | 12/2006 | Otake et al. | |
| 2008/0196873 | A1 * | 8/2008 | Svensson | F28F 3/10 165/167 |
| 2009/0071177 | A1 | 3/2009 | Unezaki et al. | |
| 2009/0241569 | A1 | 10/2009 | Okada et al. | |
| 2009/0266093 | A1 | 10/2009 | Aoki | |
| 2010/0192607 | A1 | 8/2010 | Unezaki et al. | |
| 2010/0206539 | A1 | 8/2010 | Kim et al. | |
| 2010/0319393 | A1 | 12/2010 | Ikegami et al. | |
| 2011/0005268 | A1 | 1/2011 | Oshitani et al. | |
| 2011/0023515 | A1 | 2/2011 | Kopko et al. | |
| 2011/0041523 | A1 | 2/2011 | Taras et al. | |
| 2011/0197606 | A1 | 8/2011 | Zimmermann et al. | |
| 2011/0219803 | A1 | 9/2011 | Park et al. | |
| 2011/0239667 | A1 | 10/2011 | Won et al. | |
| 2011/0256005 | A1 | 10/2011 | Takeoka et al. | |
| 2011/0283723 | A1 | 11/2011 | Yakumaru | |
| 2011/0314854 | A1 | 12/2011 | Sata et al. | |
| 2012/0006041 | A1 | 1/2012 | Ikeda et al. | |
| 2012/0060523 | A1 | 3/2012 | Hung | |
| 2012/0151948 | A1 | 6/2012 | Ogata et al. | |
| 2012/0167601 | A1 | 7/2012 | Cogswell et al. | |
| 2012/0180510 | A1 | 7/2012 | Okazaki et al. | |
| 2012/0247146 | A1 | 10/2012 | Yamada et al. | |
| 2012/0324911 | A1 | 12/2012 | Shedd | |
| 2013/0042640 | A1 | 2/2013 | Higashiiue et al. | |
| 2013/0111935 | A1 | 5/2013 | Zou et al. | |
| 2013/0111944 | A1 | 5/2013 | Wang et al. | |
| 2013/0125569 | A1 | 5/2013 | Verma et al. | |
| 2013/0174590 | A1 | 7/2013 | Sjoholm et al. | |
| 2013/0251505 | A1 | 9/2013 | Wang et al. | |
| 2014/0208785 | A1 | 7/2014 | Wallace et al. | |
| 2014/0326018 | A1 | 11/2014 | Ignatiev | |
| 2014/0345318 | A1 | 11/2014 | Nagano et al. | |
| 2015/0300706 | A1 | 10/2015 | Awa et al. | |
| 2015/0330691 | A1 | 11/2015 | McSweeney | |
| 2016/0109160 | A1 | 4/2016 | Junge et al. | |
| 2016/0169565 | A1 | 6/2016 | Yokoyama et al. | |
| 2016/0169566 | A1 | 6/2016 | Nakashima et al. | |
| 2016/0186783 | A1 | 6/2016 | Nishijima et al. | |
| 2016/0280041 | A1 | 9/2016 | Suzuki et al. | |
| 2017/0159977 | A1 | 6/2017 | Hellmann | |
| 2017/0321941 | A1 | 11/2017 | Fredslund et al. | |
| 2017/0343245 | A1 | 11/2017 | Fredslund et al. | |
| 2018/0023850 | A1 | 1/2018 | Chaudhry et al. | |
| 2018/0066872 | A1 | 3/2018 | Hellmann | |
| 2018/0119997 | A1 | 5/2018 | Siegert et al. | |
| 2018/0142927 | A1 | 5/2018 | Hellmann et al. | |
| 2018/0274821 | A1 | 9/2018 | Lee et al. | |
| 2018/0283750 | A1 | 10/2018 | Prins et al. | |
| 2018/0320944 | A1 | 11/2018 | Prins et al. | |

FOREIGN PATENT DOCUMENTS

| | | | | |
|---|---|---|---|---|
| CN | 1374491 | A | 10/2002 | |
| CN | 1776324 | A | 5/2006 | |
| CN | 1892150 | C | 1/2007 | |
| CN | 101329115 | A | 12/2008 | |
| CN | 101512255 | A | 8/2009 | |
| CN | 101922823 | A | 12/2010 | |
| CN | 102128508 | A | 7/2011 | |
| CN | 201992750 | U | 9/2011 | |
| CN | 202254492 | U | 5/2012 | |
| CN | 202304070 | U | 7/2012 | |
| CN | 103003641 | A | 3/2013 | |
| CN | 103282730 | A | 9/2013 | |
| CN | 103292623 | A | 9/2013 | |
| CN | 104359246 | A | 2/2015 | |
| CN | 104697234 | A | 6/2015 | |
| CN | 207050547 | U | 2/2018 | |
| DE | 4303669 | C1 | 1/1994 | |
| DE | 10029999 | A1 | 1/2002 | |
| DE | 10321191 | A1 | 11/2003 | |
| EP | 0005825 | A1 | 5/1979 | |
| EP | 0217605 | A2 | 4/1987 | |
| EP | 1236959 | A2 | 9/2002 | |
| EP | 1731853 | A2 | 12/2006 | |
| EP | 2068094 | A1 | 6/2009 | |
| EP | 2077427 | A1 | 7/2009 | |
| EP | 2175212 | A1 | 4/2010 | |
| EP | 2224187 | A2 | 9/2010 | |
| EP | 2504640 | A2 | 10/2012 | |
| EP | 3032208 | A1 | 6/2016 | |
| EP | 2718642 | B1 | 9/2016 | |
| EP | 3098543 | A1 | 11/2016 | |
| FR | 2844036 | A1 | 3/2004 | |
| GB | 2164439 | A | 3/1986 | |
| GB | 2164439 | A * | 3/1986 | F28F 3/10 |
| JP | H04316962 | A | 11/1992 | |
| JP | H04320762 | A | 11/1992 | |
| JP | 2001221517 | A | 8/2001 | |
| JP | 2005249315 | A | 9/2005 | |
| JP | 2009097786 | A | 5/2009 | |
| JP | 2010151424 | A | 7/2010 | |
| JP | 2014077579 | A | 5/2014 | |
| KR | 100196779 | B1 | 6/1999 | |
| KR | 20080006585 | U | 12/2008 | |
| RU | 2368850 | C2 | 9/2009 | |
| RU | 2415307 | C1 | 3/2011 | |
| RU | 2555087 | C1 | 7/2015 | |
| SU | 996805 | A1 | 2/1983 | |
| WO | 2012012488 | A1 | 1/2012 | |
| WO | 2012012493 | A2 | 1/2012 | |
| WO | 2012012501 | A2 | 1/2012 | |
| WO | 2012168544 | A1 | 12/2012 | |

(56) References Cited

FOREIGN PATENT DOCUMENTS

| | | |
|---|---|---|
| WO | 2014106030 A1 | 7/2014 |
| WO | 2016034298 A1 | 3/2016 |

OTHER PUBLICATIONS

Partial European Search Report for Serial No. 19201243.3 dated Feb. 24, 2020.
International Search Report for Application No. PCT/EP2016/074758 dated Jan. 17, 2017.
European Examination Report for Serial No. 16 781 477.1 dated Feb. 21, 2019.
Danish Search Report for Serial No. PA 2015 00644 dated May 17, 2016.
International Search Report for Application No. PCT/EP2016/074774 dated Jan. 9, 2017.
International Search Report for Application No. PCT/EP2016/074765 dated Jan. 9, 2017.
International Search Report for PCT Serial No. PCT/EP2018/057515 dated Jun. 20, 2018.
International Search Report for PCT Serial No. PCT/EP2015/064019 dated Dec. 14, 2015.
International Search Report for PCT Serial No. PCT/EP2015/073211 dated Jan. 20, 2016.
International Search Report for Application No. PCT/EP2016/065575 dated Oct. 13, 2016.
International Search Report for PCT Serial No. PCT/EP2015/073171 dated Jan. 20, 2016.
Chinese Office Action and English Translation for Serial No. 201580060854.1 dated Jan. 4, 2019.
Indian Office Action dated Jan. 27, 2020 for Appln. No. 201817003292.
Japanese Office Action and English Translation for Serial No. 2018-506946 dated May 12, 2020.
Taguchi, Air Conditioning System, Apr. 8, 1987, EP0217605A2, Whole Document (Year: 1987).

* cited by examiner

HEAT EXCHANGER PLATE WITH STRENGTHENED DIAGONAL AREA

CROSS-REFERENCE TO RELATED APPLICATION

This application claims foreign priority benefits under U.S.C. § 119 to Danish Patent Application No. PA201800725 filed on Oct. 15, 2018, the content of which is hereby incorporated by reference in its entirety.

BACKGROUND

A typical construction of a plate heat exchanger comprises a plurality of heat transfer plate stacked on top of each other. The heat transfer plates are formed with patterns such that flow paths are formed between each set of neighboring heat transfer plates. Openings and are formed in the heat transfer plates to form inlets and outlets for fluids to these flow paths. Gaskets are positioned between the heat transfer plates in gasket grooves formed in the heat transfer plates. The gasket is arranged at an edge portion of the heat transfer plate to seal the flow paths and at an area around the openings to seal pairs of the openings, such that only two of them have flow access to the flow path formed at one side of the heat transfer plate, while the other two is sealed therefrom.

Especially in the opening areas the pressures are high, but the gasket is disposed at only one side of the heat transfer plate, while the other side is unsupported, thus forming a weak section, where these weak sections in the areas of the high pressures may be deformed. Further, the gasket tends to be pushed out of position by the pressures in these in these areas.

SUMMARY

The present disclosure provides a heat transfer plate for a plate heat exchanger and a plate heat exchanger that at least partly alleviate the deformation of the heat transfer plate at the gasket groove in use.

The present disclosure further provides a heat transfer plate for a plate heat exchanger and a plate heat exchanger that at least partly alleviate the dispositioning of the gasket positioned in these areas.

The present disclosure introduces a heat transfer plate for a plate heat exchanger, the heat transfer plate comprising:

a plate body forming a patterned section and having a first side and a second side opposite to the first side;

a gasket groove depressed from the plate body in a direction from the first side towards the second side, and having a bottom wall, the bottom wall having a bottom wall body;

and where the gasket groove includes at least a first section with a first recess formed on the bottom wall body, depressed from the bottom wall body in the direction from the first side towards the second side, and a second section with a second recess formed on the bottom wall body, depressed from the bottom wall body in the direction from the second side towards the first side, wherein said second section is adapted to accommodate a gasket.

In an embodiment said plate comprises opening pairs, wherein said first section is positioned to separate said first pair from said patterned section, and said second section is positioned to separate said second pair from said patterned section, and where, when a gasket is positioned in said second section, then said second pair is sealed from said first side patterned section, whereas when no gasket is positioned in said first section, said first pair forms respectively inlet and outlet to the first side.

In an embodiment the gasket groove further includes a third section with a flat bottom wall body connecting a first section of respectively an inlet to an outlet of said first opening pair and a second section of respectively and an inlet to an outlet of said second opening pair.

In an embodiment the heat transfer plate is provided with structures in the plate body forming flow paths when connected to an upper neighbouring heat transfer plate, and openings forming inlets and outlets to the flow paths, and where a gasket is positioned in said second section first side and contacted by the neighbouring plate first section second side, whereby said gasket forms a sealing between the first side flow paths of said heat transfer plate and the second opening pair.

In one embodiment, said heat transfer plate is connected to a lower neighbouring heat transfer plate, where the first side of said first section is empty, meaning no gasket is positioned in said first section, but where its lower surface, the second side surface, contacts a gasket positioned in a second section of said lower neighbouring heat transfer plate.

In one embodiment, the gasket is shaped at the upper and/or lower surface with an upper recess and/or lower recess to receive the heat transfer plate second recess and/or the upper neighbouring heat transfer plate first recess. This has the effect of the recesses 'hooking' into the gasket keeping it in place.

In one embodiment, the gasket is not shaped at the upper and lower surface according to the shapes of second recess and the upper neighbouring heat transfer plate first recess but is deformed by the first and second recesses respectively when squeezed between the two heat transfer plates. This has the effect of the first and second recess squeezing themselves into the gasket material, which by e.g. the friction and the elasticity of the gasket helps to keep the gasket in position. Further, if there should be some minor deformation of the heat transfer plate in the area, the elasticity of the gasket material would ensure contact if the deformation is of the plates is less than the deformation of the gasket.

In one embodiment, the first recess and second recess are differently shaped.

In one embodiment, the first recess and second recess have different widths.

In one embodiment, the first section has a first width and second section has second width different from said first width.

In one embodiment, the first width is smaller than the second width, such that when an upper heat transfer plate is stacked on top of said heat transfer plate, the outer portions of the upper heat transfer plate is positioned on the part of the plate body at the side of the second section of said heat transfer plate. This ensures a strengthening of the area where a gasket only is positioned in every second heat transfer plate.

The present further in an embodiment relate to a heat transfer plate for a plate heat exchanger, the heat transfer plate comprising:

a plate body forming a patterned section and having a first side and a second side opposite to the first side;

a gasket groove formed on the plate body, depressed from the plate body in a direction from the first side towards the second side, and having a bottom wall, the bottom wall having a bottom wall body;

and where the gasket groove includes at least a first section with a first width, and a second section with a second width, wherein the first width is smaller than the second width, such that when an upper heat transfer plate is stacked on top of said heat transfer plate, the outer portions of the upper heat transfer plate is positioned on the part of the plate body at the side of the second section of said heat transfer plate.

FIGURES

FIG. 1 Heat exchanger stack according to prior art.

Figure 2:
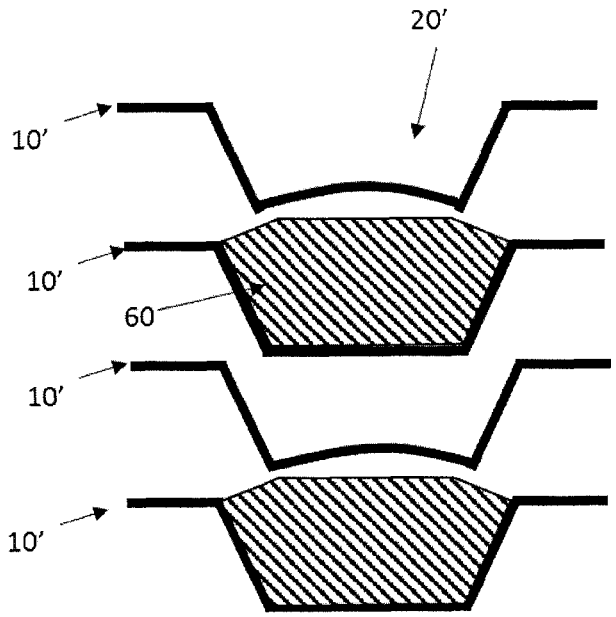

FIG. 2 Deformation of heat exchanger stack according to prior art.

Figure 3:
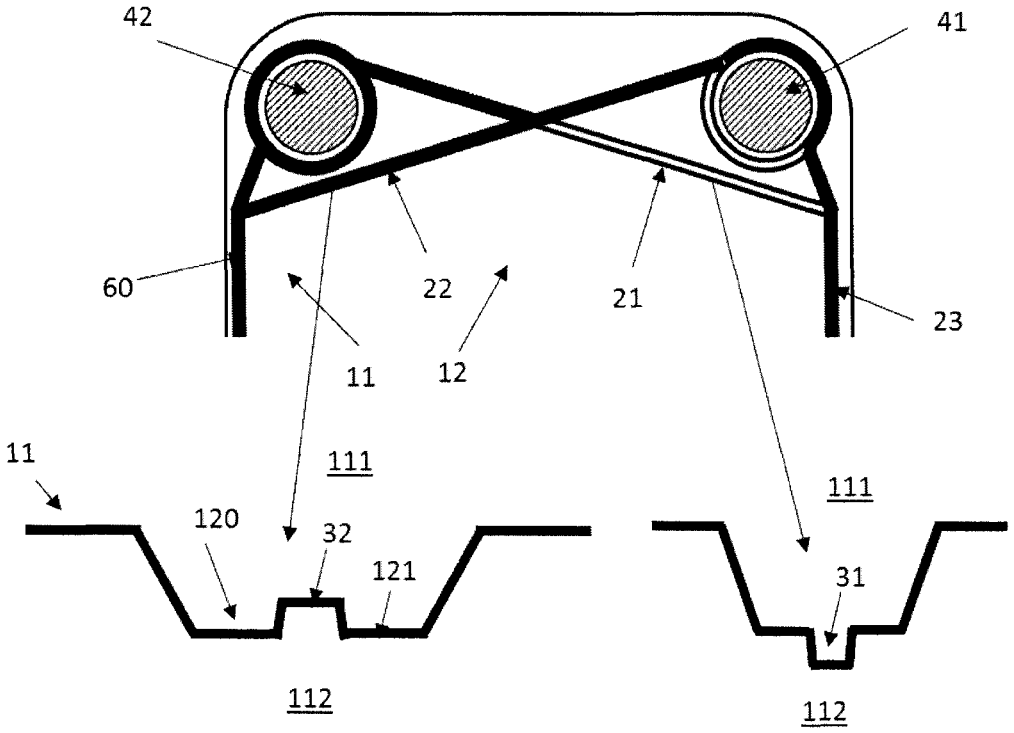

FIG. 3 Heat transfer plate diagonal area with recessed first and second gasket groove sections according to an embodiment of the present invention.

Figure 4A:
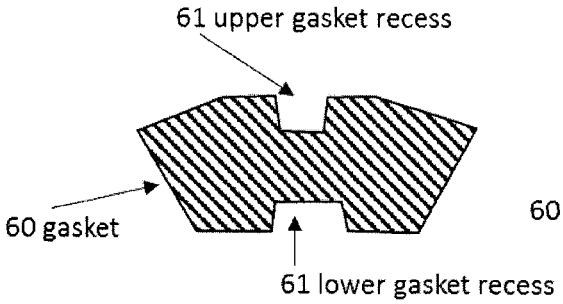

FIGS. 4A, B Cross sections of two different gasket designs to be used in the heat transfer plates according to the present invention.

Figure 5A:
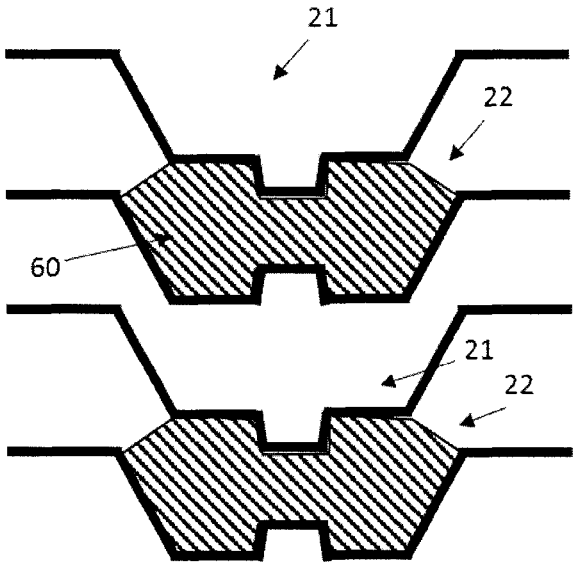

FIGS. 5A, B Illustrations of two different embodiments of said respectively first and second sections of said gasket grooves stacked on top of each other.

DETAILED DESCRIPTION

It should be understood, that the detailed description and specific examples, while indicating embodiments of the invention, are given by way of illustration only, since various changes and modifications within the spirit and scope of the invention will become apparent to those skilled in the art from the detailed description.

FIG. 1 shows a typical construction of a plate heat exchanger 1'. The plate heat exchanger 1' comprises a plurality of heat transfer plate 10' stacked on top of each other. The heat transfer plates 10' are formed with a patterned section 11 such that flow paths are formed between each set of neighboring heat transfer plates 10'. Openings 41 and 42 are formed in the heat transfer plates 10' to form inlets and outlets for fluids to these flow paths. Gaskets 60 are positioned between the heat transfer plates 10' in gasket grooves 20' formed in the heat transfer plates. The gasket 60 is arranged at an edge portion of the heat transfer plate to seal the flow paths and at an area around the openings to seal pairs of the openings 41, 42, such that only two 41 of them have flow access to the flow path formed at one side of the heat transfer plate, while the other two 42 is sealed therefrom. The arrows with broken lines illustrate the flow of a fluid along the first side 111 patterned section 11 from an inlet to an outlet 31.

Especially in the opening areas the pressures are high, but the gasket 60 is disposed at only one side of the heat transfer plate 10', while the other side is unsupported, thus forming a weak section.

As shown in FIG. 2, these weak sections in the areas of the high pressures may be deformed.

Figure 4B:
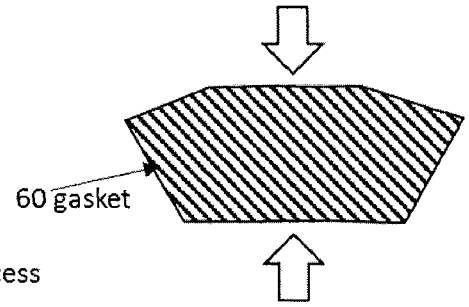

In an embodiment, referring to FIGS. 3, 4A and 4B, the heat transfer plate 10 comprises a plate body 11 having a first side 111 and a second side 112 opposite to the first side 111. The heat transfer plate 10 further comprises a gasket groove 20 which is formed on the plate body 11, is depressed from the plate body 11 in a direction from the first side 111 towards the second side 112 and has a bottom wall 120 with a bottom wall body 121.

The gasket groove 20 includes at least a first section 21 with a first recess 31 formed on the bottom wall body 121, depressed from the bottom wall body 121 in the direction from the first side 111 towards the second side 112, and a second section 22 with a second recess 32 formed on the bottom wall body 121, depressed from the bottom wall body 121 in the direction from the second side 111 towards the first side 112. The respectively first section 21 and second section 22 is positioned such that said first section 31 separate the first pair 41 of openings, and the second section 22 separate the second pair 42 of openings, from the heat exchanging sections of the flow paths formed by the combined patterned sections 12 of connected neighbouring plates.

In an embodiment, the first section 21 is provided with a first recess 31 formed on the bottom wall body 121, depressed from the bottom wall body 121 in the direction from the first side 111 towards the second side 112. The second section 22 is provided with a second recess 32 formed on the bottom wall body 121, depressed from the bottom wall body 121 in the direction from the second side 111 towards the first side 112. The first 31 and second 32 recess thus project to opposite directions relative to the plate body 11 and to each other. Seen from one side of the plate body 11 first recess 31 and second 32 recess naturally will be recesses, whereas from the other they will appear as projections.

The first and second recesses 31, 32 in themselves ensures some rigidity to the heat transfer plate 10 material in the opening areas (often referred to as the diagonal areas) which is better able to withstand the pressures in these areas, making them less prone to bending or deformation, but also assists in keeping the gasket in place, as will also be discussed later.

In an embodiment the gasket groove 20 further includes a third section 23 formed in the edge portion at the circumference of the heat transfer plate 10, possible also having sections partly or fully encircling the openings 41, 42.

When the heat exchanger 1 is formed is stacked by stacking heat exchanger plates 10 according to any embodiment, a gasket 60 is positioned in the gasket groove 20 except in the first section 21.

The third section 23 will form the sealing to the external of the heat exchanger 1, and will be positioned such that it is positioned in combination with third sections 23 of the upper and lower connected heat transferring plates 10, such that the gasket 60 is squeezed between the third section 23 first side 111 bottom wall and the upper neighbouring heat transferring plate 10 third section 23 second side 112.

The first section 21 will be empty of a gasket 60, such that there will be access from the first opening pair 41 to the patterned section 12, this pair then will form inlet and outlet to the flow path formed at the first side 111 of the heat transfer plate 10.

The second section 22 will comprise a gasket 60 sealing off fluid from the second pair 42 to the first side 111 flow path.

As also indicated in relation to FIG. 1, when stacking the heat transfer plates 10 to form the heat exchanger 1, a first section 21 will be aligned with a second section 22 of both an upper and lower neighbouring heat transfer plate 10, and correspondingly a second section 22 will be aligned with a first section 21 of both an upper and lower neighbouring heat transfer plate 10. Therefore, in these areas, the diagonal areas, every second heat exchanger plate 10 is unsupported by a gasket 60.

The third section 23 may have any shape of the bottom wall body 121, such as being flat, and may further connect a first section 21 of respectively an inlet to an outlet of said first opening pair 41 and a second section 22 of respectively and an inlet to an outlet of said second opening pair 42.

Each of the first 21, second 22 and third sections 23 may be a single section only or could each be a plural of sections of the gasket grove 20. They could be meandering sections or branched, open or closes sections.

In an embodiment the gasket 60 is shaped at the upper and lower surface with an upper recess 61 and/or lower recess 62 as seen in FIG. 4A to receive the heat transfer plate 10 second recess 32 and/or the upper neighbouring heat transfer plate 10 first recess 31.

In an embodiment as illustrated in FIG. 4B, the gasket 60 is not shaped according to the first 31 and second 32 recesses but could have upper and lower surfaces in any shape, such as flat as illustrated. In this embodiment the gasket 60 is being deformed by the first 31 and second 32 recesses respectively when squeezed between the two heat transfer plates 10. This is to be understood such that the whole of the gasket 60 may be squeezed a bit making a first general deformation of the gasket 60, but the first 31 and/or second 32 recesses push into the gasket 60 material with a second deformation.

In one embodiment combining the features of FIGS. 4A and 4B, then the gasket 60 comprises either the upper 61 or lower 62 gasket recess, whereas the other of the upper or lower of the gasket 60 surfaces is unshaped according to the first 31 or second 32 recess, such as seen in FIG. 4B.

In any of the embodiments the first 31 and second 32 recess thus assists in keeping the gasket 60 in position.

In an embodiment the first recess 31 and second recess 32 is differently shaped, which could be that they have different widths, or could be simply the form of the recess 31, 32 is different, e.g. one having flat tops being square like, another being triangular like with pointing ends etc.

FIG. 5A illustrate the aligned respectively first 21 and second 22 sections where four heat transfer plates 10 is stacked on top of each other, and where a gasket is situated within every second plate.

Figure 5B:
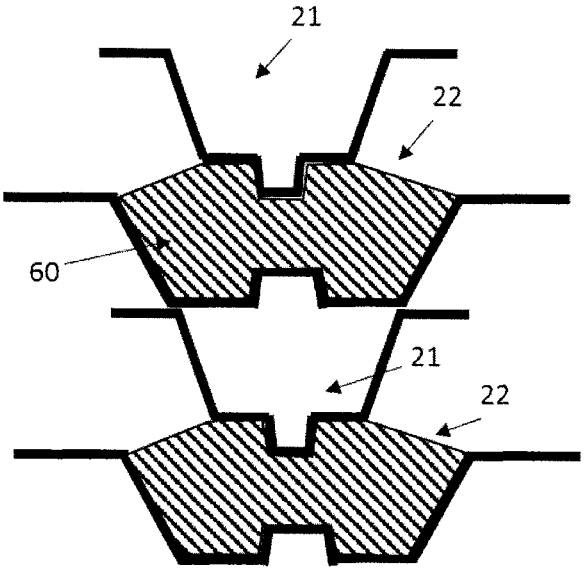

FIG. 5B illustrated an embodiment where the first section 21 has a first width and second section 22 has second width different from said first width. In one embodiment as illustrated the first width is smaller than the second width, such that when an upper heat transfer plate 10 is stacked on top of said heat transfer plate 10, the outer portions of the upper heat transfer plate 10 is positioned on the part of the plate body 11 at the side of the second recess 22 of said heat transfer plate 10.

It should be understood for any of the embodiments, that the first 21 and second 22 sections usually will not have 'continuous' walls, though it may appear as such from the illustrations, but will have a number of open sections in the walls forming the fluidic communication between an inlet and outlet 41, 42 and the patterned sections 12. When referring to respectively the first width and second width, this thus implies a general width of the sections 21, 22, such as where it does comprise walls opposite to each other. It should also be understood that in any of the embodiments the first and second widths may change along the length extensions of the first and second sections 21, 22, just as the widths of the first 31 and second 32 recesses may change.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A plate heat exchanger comprising:

first and second heat transfer plates, each heat transfer plate having a plate body forming a patterned section and having a first side and a second side opposite to the first side;

each heat transfer plate having a gasket-groove formed depressed from the plate body in a direction from the first side towards the second side, and having a bottom wall, the bottom wall having a bottom wall body;

wherein the gasket groove includes one or more first sections, each first section with a first recess formed on the bottom wall body, the first recess depressed from the bottom wall body in the direction from the first side towards the second side, and one or more second sections, each second section with a second recess formed on the bottom wall body, the second recess depressed from the bottom wall body in the direction from the second side towards the first side;

wherein each heat transfer plate comprises a first pair of openings, including a first inlet and a first outlet, and a second pair of openings, including a second inlet and a second outlet;

wherein on the second heat transfer plate one or more first sections are positioned to separate the patterned section from the first inlet and the first outlet, and one or more second sections are positioned to separate the patterned section from the second inlet and the second outlet;

wherein the first heat transfer plate is stacked on the second heat transfer plate;

wherein one or more gaskets are located between the first and second heat transfer plates and are positioned in the one or more second sections of the second heat transfer plate; and wherein the one or more gaskets seal the second inlet and second outlet from the patterned section which is located between the first and second heat transfer plates.

2. The plate heat exchanger according to claim 1, wherein no gasket is positioned in said first section of the second heat transfer plate, and said first inlet and said first outlet of the second heat transfer plate have flow access to flow paths formed within the patterned section between the first and second heat transfer plates.

3. The plate heat exchanger according to claim 1, wherein the second heat transfer plate includes two first sections associated with the first inlet and the first outlet, respectively, and two second sections associated with the second inlet and the second outlet, respectively, and wherein the gasket groove further includes a third section with a flat bottom wall body connecting the two first sections or connecting the two second sections.

4. The plate heat exchanger according to claim 1, wherein the gasket positioned in said second section of the second heat transfer plate is contacted by the second side of the first section of the first heat transfer plate.

5. The plate heat exchanger according to claim 1, wherein said first side of said first section of the first heat transfer plate is empty, but said second side of said first section of the first heat transfer plate contacts the gasket positioned in a second section of said second heat transfer plate.

6. The plate heat exchanger according to claim 1, wherein said gasket is shaped at an upper surface with an upper recess to receive the first recess of the first heat transfer plate and/or wherein said gasket is shaped at a lower surface with a lower recess to receive the second recess of the second heat transfer plate.

7. The plate heat exchanger according to claim 1, wherein the gasket is not shaped at the upper and lower surface according to the shapes of the first recess and the second recess, respectively, but is deformed by the first and second recesses respectively when squeezed between the two heat transfer plates.

8. The plate heat exchanger according to claim 1, wherein the first recess and second recess are differently shaped.

9. The plate heat exchanger according to claim 1, wherein the first recess and second recess have different widths.

10. The plate heat exchanger according to claim 1, wherein the first section has a bottom wall first width and the second section has a bottom wall second width different from said first width.

11. The plate heat exchanger according to claim 10, wherein the first width is smaller than the second width, such that when the first heat transfer plate is stacked on top of the second heat transfer plate, a portion of the second side of at least one second section of the first heat transfer plate is positioned on a part of the plate body forming at least one first section of said second heat transfer plate.

12. The plate heat exchanger according to claim 3, wherein the gasket positioned in said second section of the second heat transfer plate is contacted by the second side of the first section of the first heat transfer plate.

13. The plate heat exchanger according to claim 4, wherein said gasket is shaped at an upper surface with an upper recess to receive the first recess of the first heat transfer plate and/or wherein said gasket is shaped at a lower surface with a lower recess to receive the second recess of the second heat transfer plate.

14. The plate heat exchanger according to claim 4, wherein the gasket is not shaped at the upper and lower surface according to the shapes of the first recess and the second recess, respectively, but is deformed by the first and second recesses respectively when squeezed between the two heat transfer plates.

15. The plate heat exchanger according to claim 3, wherein the first recess and second recess are differently shaped.

16. The plate heat exchanger according to claim 4, wherein the first recess and second recess are differently shaped.

17. The plate heat exchanger according to claim 1, wherein the first recess of the first heat transfer plate and the second recess of the second heat transfer plate extend into the gasket.

18. The plate heat exchanger according to claim 1, wherein on the first heat transfer plate one or more second sections are positioned to separate the patterned section from the first inlet and the first outlet, and one or more first sections are positioned to separate the patterned section from the second inlet and the second outlet.

* * * * *